US007537402B2

(12) United States Patent
Takahashi et al.

(10) Patent No.: US 7,537,402 B2
(45) Date of Patent: May 26, 2009

(54) THERMAL ACTIVATION DEVICE AND PRINTER

(75) Inventors: Masanori Takahashi, Chiba (JP); Hiroyuki Kohira, Chiba (JP); Yoshinori Sato, Chiba (JP); Minoru Hoshino, Chiba (JP); Tatsuya Obuchi, Chiba (JP)

(73) Assignee: Seiko Instruments Inc. (JP)

( * ) Notice: Subject to any disclaimer, the term of this patent is extended or adjusted under 35 U.S.C. 154(b) by 395 days.

(21) Appl. No.: 11/137,846

(22) Filed: May 25, 2005

(65) Prior Publication Data

US 2005/0271443 A1 Dec. 8, 2005

(30) Foreign Application Priority Data

Jun. 1, 2004 (JP) ..... 2004-163089

(51) Int. Cl.
*B41J 2/315* (2006.01)
*B41J 2/32* (2006.01)

(52) U.S. Cl. ..... 400/120.17; 400/120.01; 400/120.16; 400/648; 347/197; 347/198

(58) Field of Classification Search ..... 347/171, 347/197, 198, 215, 216, 220, 221, 222; 400/120.01, 400/120.16–120.18, 648, 649–660.2, 660.3; 156/60, 106, 277, 282, 304.6, 309.9, 364, 156/384–387

See application file for complete search history.

(56) References Cited

U.S. PATENT DOCUMENTS 5,366,302 A 11/1994 Masumura et al.
5,709,488 A * 1/1998 Imai et al. ..... 400/234
6,388,692 B1 * 5/2002 Iwata et al. ..... 347/212
2001/0001273 A1 5/2001 Mori et al.
2003/0118390 A1 6/2003 Yamada et al.

FOREIGN PATENT DOCUMENTS

EP 0 925 947 A1 6/1999
EP 1 108 556 A1 6/2001
JP 11-010925 * 1/1999

OTHER PUBLICATIONS

Patent Abstracts of Japan vol. 016, No. 434 (M-1308), Sep. 10, 1992, publication No. 04148749, publication date May 21, 1992.

* cited by examiner

*Primary Examiner*—Daniel J. Colilla
*Assistant Examiner*—N. Ha
(74) *Attorney, Agent, or Firm*—Adams & Wilks

(57) ABSTRACT

A thermal activation device includes a platen lock mechanism for locking a platen roller of a platen unit and a heating unit or printing unit into press contact with each other. The platen lock mechanism has a lock arm mounted to undergo rotation about a rotational axis, a shaft member provided in one of the platen unit and the lock arm, an engagement recess for engagingly receiving the shaft member and provided in the other of the platen unit and the lock arm, and an urging member for urging the lock arm in a direction for bringing the shaft member into engagement with the engagement recess. In a state in which the heating unit or printing unit is in press contact with the platen roller, a distance between the rotational axis of the lock arm and an axis of the shaft member is greater than a distance between the rotational axis of the lock arm and the rotational axis of the platen roller.

11 Claims, 10 Drawing Sheets

THERMAL ACTIVATION DEVICE

LABEL ISSUING INSTRUMENT 1

THERMAL ACTIVATION DEVICE 10

10

THERMAL ACTIVATION DEVICE thermal activation device 110

PRIOR ART

THERMAL ACTIVATION DEVICE AND PRINTER

BACKGROUND OF THE INVENTION

1. Field of the Invention

The present invention relates to a thermal activation device for thermally activating a heat-sensitive adhesive layer of a sheet material having a printing layer formed on one surface of a sheet-like base material and having the heat-sensitive adhesive layer formed on the other surface, and relates to a printer for performing printing on the sheet material in which the printing layer is provided on the one surface of the sheet-like base material.

2. Description of the Related Art

For example, in a distribution center and shops, labels for displaying various types of information such as prices and for displaying barcodes for management by means of POS (point of sales) terminals have been used by being attached to articles. As this type of label, a proposal has been made of a label, which is issued using a sheet material having a printing layer formed on one surface of a sheet-like base material and a heat-sensitive adhesive layer formed on the other surface thereof.

In general, a label issuing instrument which issues the label having the heat-sensitive adhesive layer as described above includes a sheet supply apparatus that supplies the sheet material, a printing apparatus that prints various types of information on a thermal printing layer of the sheet material supplied from the sheet supply apparatus, a cutting apparatus that cuts the sheet material for which the printing has been performed by the printing apparatus, and a thermal activation device that thermally activates the heat-sensitive adhesive layer of the sheet material.

Basic constructions of the conventional printing apparatus and thermal activation device are similar to each other, and each of the apparatuses has a platen roller for conveying the sheet material, with the thermal head and the thermal activation head being brought into press contact with the platen roller. In each of such conventional printing apparatus and thermal activation device, a so-called clamshell-type construction has been adopted, which includes a platen unit that is movable so as to bring the platen roller into and out of contact with the thermal head or the thermal activation head, and exposes the thermal head and the thermal activation head to the outside of the apparatus, thus facilitating exchange, maintenance, etc. of the heads. Moreover, in each of other conventional clamshell-type printing apparatuses and thermal activation devices, a construction has also been adopted, in which the thermal head and the thermal activation head are movable so as to come into and out of contact with the platen roller.

Moreover, each of the conventional clamshell-type printing apparatus and thermal activation device includes a platen lock mechanism for locking the platen unit so as to fix movement thereof in a state where the thermal head or the thermal activation head is brought into press contact with the platen roller.

With regard to the conventional clamshell-type printing apparatus, a construction including a platen lock mechanism having a lock arm engaged with a shaft portion of the platen roller has been disclosed (for example, refer to JP 2003-200624 A).

Likewise, as shown in FIG. 11, a conventional thermal activation device 110 includes a platen lock mechanism 119 for locking a thermal activation head 111 into press contact with a platen roller 112. The platen lock mechanism 119 has a lock arm 132 provided so as to be rotatable. In the lock arm 132, an engagement groove 137, which is engaged with an outer peripheral portion of a bearing 126 that holds a rotary shaft 125 of the platen roller 112 so as to be freely rotatable, is formed by being notched.

The platen lock mechanism 119 operates to rotate the lock arm 132. Thus, an engaged state of the bearing 126 of the platen roller 112 and the lock arm 132 is released, and a platen unit (not shown) which supports the platen roller 112 is rotationally driven in a direction of an arrow $c_2$, and the platen roller 112 is moved to a position spaced apart from the thermal activation head 111. Meanwhile, in the platen lock mechanism 119, the platen unit (not shown) which supports the platen roller 112 is rotationally driven in a direction of an arrow $c_1$, the platen roller 112 is moved into press contact with the thermal activation head 111, and the bearing 126 of the platen roller 112 and the engagement groove 137 of the lock arm 132 are engaged with each other.

As described above, the platen lock mechanism provided in the conventional clamshell-type printing apparatus or thermal activation device has the lock arm engaged with the rotary shaft of the platen roller or the outer peripheral portion of the bearing thereof.

Hence, in the conventional printing apparatus or thermal activation device, an operation range of the rotating lock arm is relatively large, and a conveyor roller is placed at a position not inhibiting the movement of the lock arm. When the operation range of the rotating lock arm is to be secured, a distance between the conveyor roller and the platen roller cannot be shortened. Accordingly, it has been difficult to achieve miniaturization of the entire apparatus.

Moreover, because the distance between the conveyor roller and the platen roller cannot be shortened, a sheet material that is a cut sheet shorter than the distance between the conveyor roller and the platen roller cannot be conveyed, and it has been impossible to handle such a relatively short sheet material.

Furthermore, in the conventional thermal printer, the operation range of the lock arm is relatively large, and accordingly, in the case of using a compression coil spring which urges the lock arm, it is necessary to ensure relatively large compression for the compression coil spring. This leads to enlargement of the compression coil spring, and thus it has been difficult to miniaturize the entire apparatus.

SUMMARY OF THE INVENTION

In view of the above, it is an object of the present invention to provide a thermal activation device and a printer which are capable of achieving miniaturization of the entire apparatus and of conveying a sheet material having a relatively short length in the conveying direction.

To attain the above object, a thermal activation device according to the present invention includes: heating means for thermally activating a heat-sensitive adhesive layer of a sheet material having the heat-sensitive adhesive layer; a platen unit that includes a platen roller for conveying the sheet material, the platen roller being brought into press contact with the heating means, the platen unit being movable in a direction for bringing the platen roller into and out of contact with the heating means; and a platen lock mechanism for locking the platen roller and the heating means into press contact with each other, the platen lock mechanism including a lock arm that is rotatable and engaged with the platen unit, and urging means for urging the lock arm in a direction for bringing the lock arm into engagement with the platen roller. The platen lock mechanism includes a shaft member provided in one of the platen unit and the lock arm, and an engagement recess which is provided in the other and with which the shaft member is engaged. Further, in the platen lock mechanism, an axis of the shaft member is provided at a position farther than a position of a rotation center of the platen roller with respect to a rotation center of the lock arm, with the printing means being in press contact with the platen roller.

According to the thermal activation device of the present invention, which is constructed as described above, as the shaft member is separating from the rotation center of the lock arm, the operation range of the lock arm when the lock arm shifts between a locking state and an unlocking state is reduced. Accordingly, it is possible to reduce the requisite urging force by the urging means, and the urging means is miniaturized, thus making it possible to achieve the miniaturization of the entire apparatus. Moreover, according to the thermal activation device of the present invention, it is possible to place the shaft member at a position spaced apart from the vicinity of the platen roller, where relatively many components are placed, and it is possible to handle conveyance of a sheet material having a short length in the conveying direction.

In the thermal activation device according to the present invention, an outer diameter of the shaft member is smaller than one of an outer diameter of a rotary shaft of the platen roller and an outer diameter of a bearing that supports the rotary shaft.

With this construction, the operation range of the lock arm when the lock arm shifts between the locking state and the unlocking state is further reduced, and further miniaturization of the entire apparatus can be achieved.

Further, according to another aspect of the present invention, a thermal activation device includes: heating means for thermally activating a heat-sensitive adhesive layer of a sheet material having the heat-sensitive adhesive layer; a platen unit that includes a platen roller for conveying the sheet material, the platen roller being brought into press contact with the heating means, the platen unit being movable in a direction for bringing the platen roller into and out of contact with the heating means; and a platen lock mechanism for locking the platen roller and the heating means into press contact with each other, the platen lock mechanism including a lock arm that is rotatable and engaged with the platen unit, and urging means for urging the lock arm in a direction for bringing the lock arm into engagement with the platen roller. The platen lock mechanism includes a shaft member provided in one of the platen unit and the lock arm, and an engagement recess which is provided in the other and with which the shaft member is engaged. Further, an outer diameter of the shaft member is smaller than one of an outer diameter of a rotary shaft of the platen roller and an outer diameter of a bearing that supports the rotary shaft.

Moreover, the thermal activation device according to the present invention may include a pair of conveyor rollers for conveying the sheet material to the heating means side. The operation range of the lock arm is reduced, and accordingly, it is possible to place the conveyor rollers close to the platen roller side without inhibiting the rotation of the lock arm, and the overall miniaturization of the apparatus can be achieved. In addition, it is also possible to handle a sheet material whose length in the conveying direction is relatively short. Hence, according to the thermal activation device, the shortest sheet material length which the apparatus can handle can be further shortened.

Further, the platen lock mechanism equipped to the thermal activation device according to the present invention is also applicable to a printer that includes: printing means for performing printing on a sheet material; and a platen unit that includes a platen roller for conveying the sheet material, the platen roller being brought into press contact with the printing means, the platen unit being movable in a direction for bringing the platen roller into and out of contact with the printing means.

As described above, the thermal activation device and the printer in accordance with the present invention each includes the platen lock mechanism including the shaft member provided in one of the platen unit and the lock arm, and the engagement recess provided in the other with which the shaft member is engaged. With the heating means being in press contact with the platen roller, the axis of the shaft member is provided at the position farther than the position of the rotation center of the platen roller with respect to the rotation position of the lock arm, or alternatively, the outer diameter of the shaft member is set smaller than the outer diameter of the rotary shaft of the platen roller or the outer diameter of the bearing which supports the rotary shaft, whereby the miniaturization of the entire apparatus can be achieved.

DETAILED DESCRIPTION OF THE PREFERRED EMBODIMENTS

Specific embodiments of the present invention will be described below with reference to the drawings.

First, a label issuing instrument to be used in the case of issuing a label attached to an article for displaying various types of information on the article will be briefly described.

Figure 1:
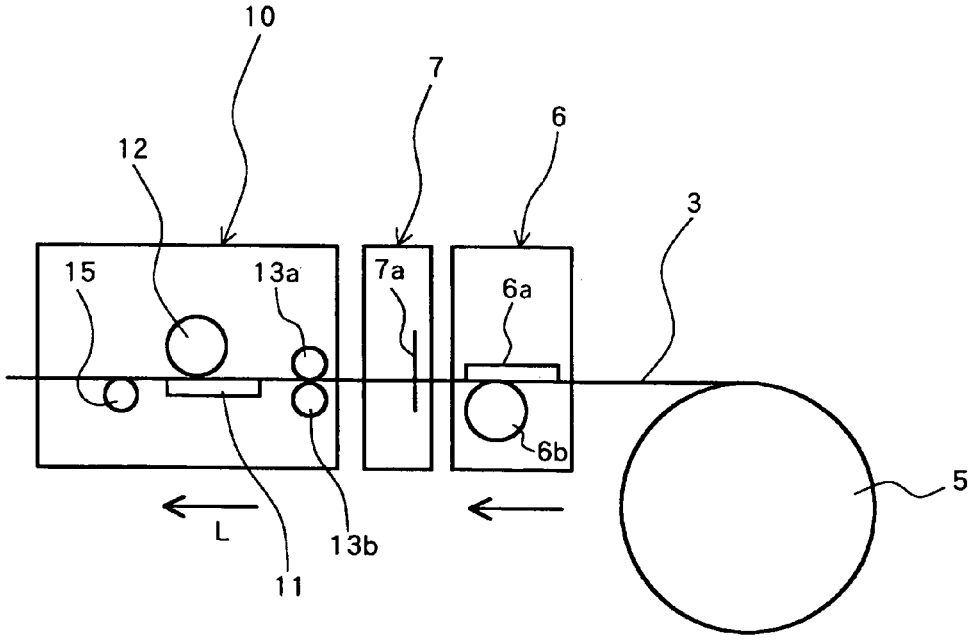
FIG. 1 is a schematic view showing a label issuing apparatus including a thermal activation device according to the present invention.

As shown in FIG. 1, a label issuing instrument 1 includes a printing apparatus 6 that prints various types of information on a thermal printing layer of a sheet material 3 which is supplied from a sheet roll 5 around which the sheet material 3 is wound, a cutting apparatus 7 that cuts the sheet material 3 for which the printing has been performed by the printing apparatus 6, and a thermal activation device 10 that thermally activates a heat-sensitive adhesive layer of the sheet material 3, which are provided in the stated order along a conveyor route of the sheet material 3 in the direction indicated by an arrow L in FIG. 1.

Although not shown, the sheet material 3 includes a sheet-like base material, the thermal printing layer formed on a surface side of the sheet-like base material, and the heat-sensitive adhesive layer provided on a back surface side of the sheet-like base material. Note that, according to needs, there may be employed as the sheet material one having a construction in which a heat-insulating layer for shielding heat conduction from one-side layer of the sheet-like base material to the other-side layer thereof is provided between the sheet-like base material and the thermal printing layer.

Figure 2:
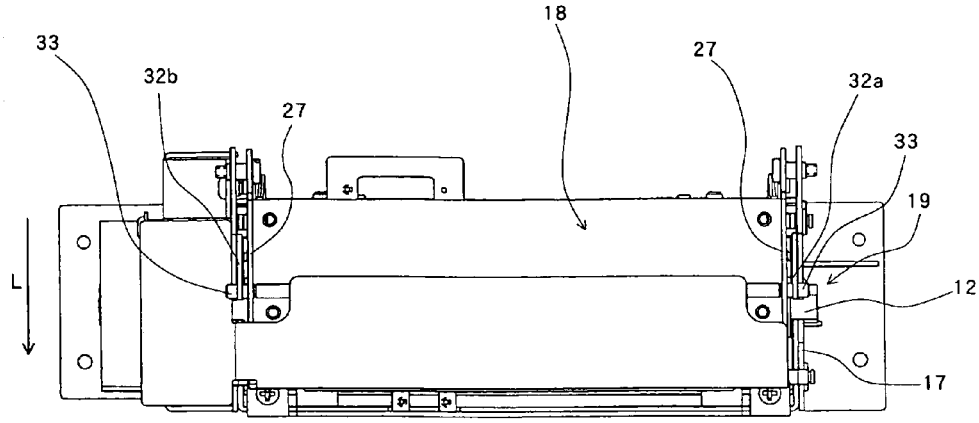
FIG. 2 is a plan view showing the thermal activation device.
Figure 3:
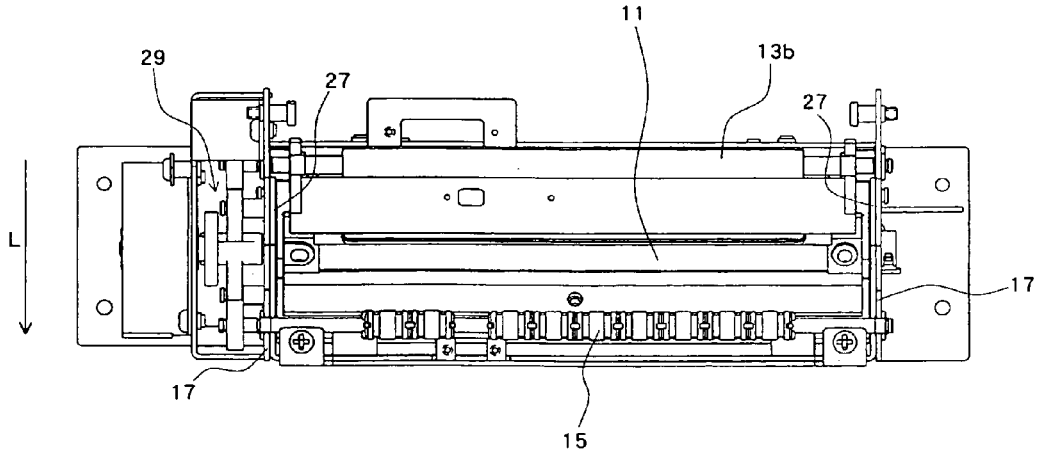
FIG. 3 is a plan view showing a state where a platen unit is detached from the thermal activation device.
Figure 4:
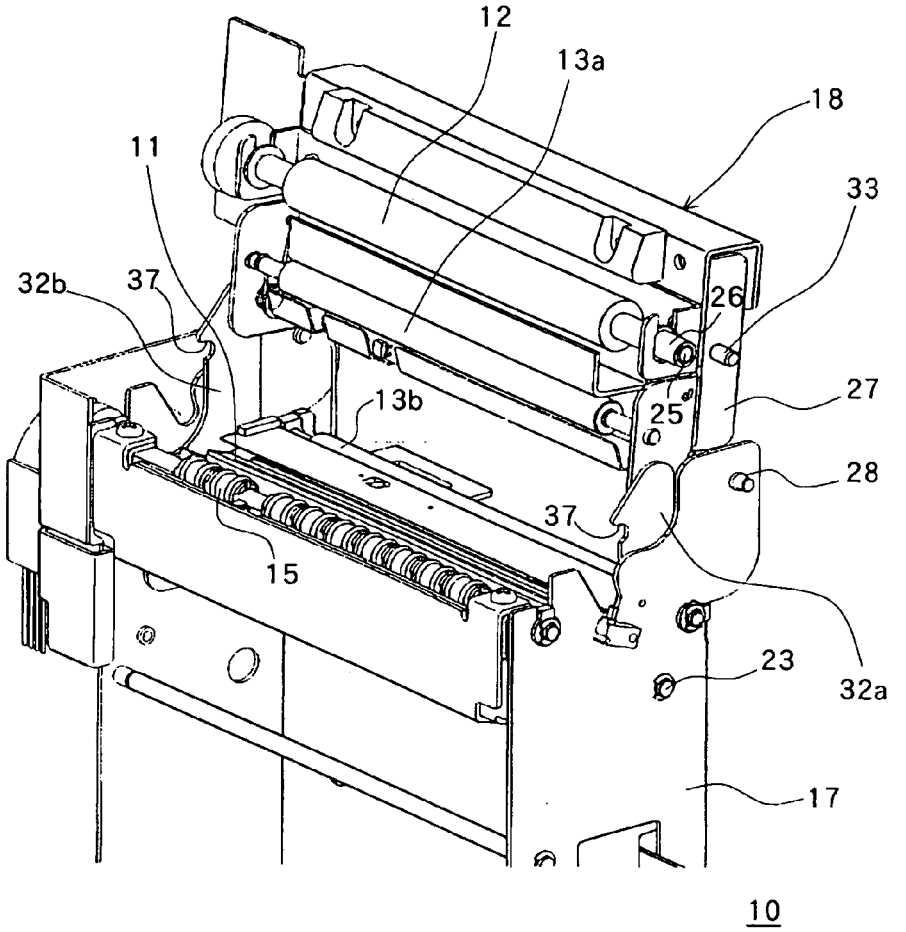
FIG. 4 is a perspective view for explaining the thermal activation device.

A so-called thermal printer is used as the printing apparatus 6, and the printing apparatus 6 includes a thermal head 6*a* for making the thermal printing layer of the sheet material 3 heat-sensitive, and a platen roller 6*b* brought into press contact with the thermal head 6*a*. While sandwiching the sheet material 3 supplied from the sheet supply apparatus 5 between the thermal head 6*a* and the platen roller 6*b*, the printing apparatus 6 performs printing for the sheet material 3, and conveys the sheet material 3. Note that the printing apparatus 6 may be disposed on a downstream side of the thermal activation device 10 in the conveying direction of the sheet material 3 according to needs. The cutting apparatus 7 includes a cutter 7*a* for cutting the sheet material 3 discharged from the printing apparatus 6 into a desired length, and conveys the sheet material 3 thus cut to the thermal activation device 10. As shown in FIGS. 2, 3 and 4, the thermal activation device 10 includes a thermal activation head 11 for thermally activating the heat-sensitive adhesive layer of the sheet material 3, a platen roller 12 which is brought into press contact with the thermal activation head 11 and conveys the sheet material 3 in the conveying direction as the direction indicated by the arrow L while sandwiching the sheet material 3 between the platen roller 12 itself and the thermal activation head 11, a pair of feed-in rollers 13*a* and 13*b* for feeding the sheet material 3 conveyed from the cutting apparatus 7 into the thermal activation device 10, and a discharge roller 15 for discharging the sheet material 3 thermally activated by the thermal activation head 11 to the outside of the thermal activation device 10.

Moreover, the thermal activation device 10 includes base frames 17 each of which supports the thermal activation head 11, a platen unit 18 which supports the platen roller 12, and a platen lock mechanism 19 which locks the platen unit 18 into a state where the platen roller 12 is in press contact with the thermal activation head 11.

As the thermal activation head 11, one similar to the thermal head 6*a* provided to the printing apparatus 6 is used, and plural heating elements (not shown) are placed along the width direction perpendicular to the conveying direction of the sheet material 3. The thermal activation head 11 selectively heats arbitrary heating elements, thus making it possible to thermally activate the heat-sensitive adhesive layer per dot unit in the width direction of the sheet material 3.

Figure 8:
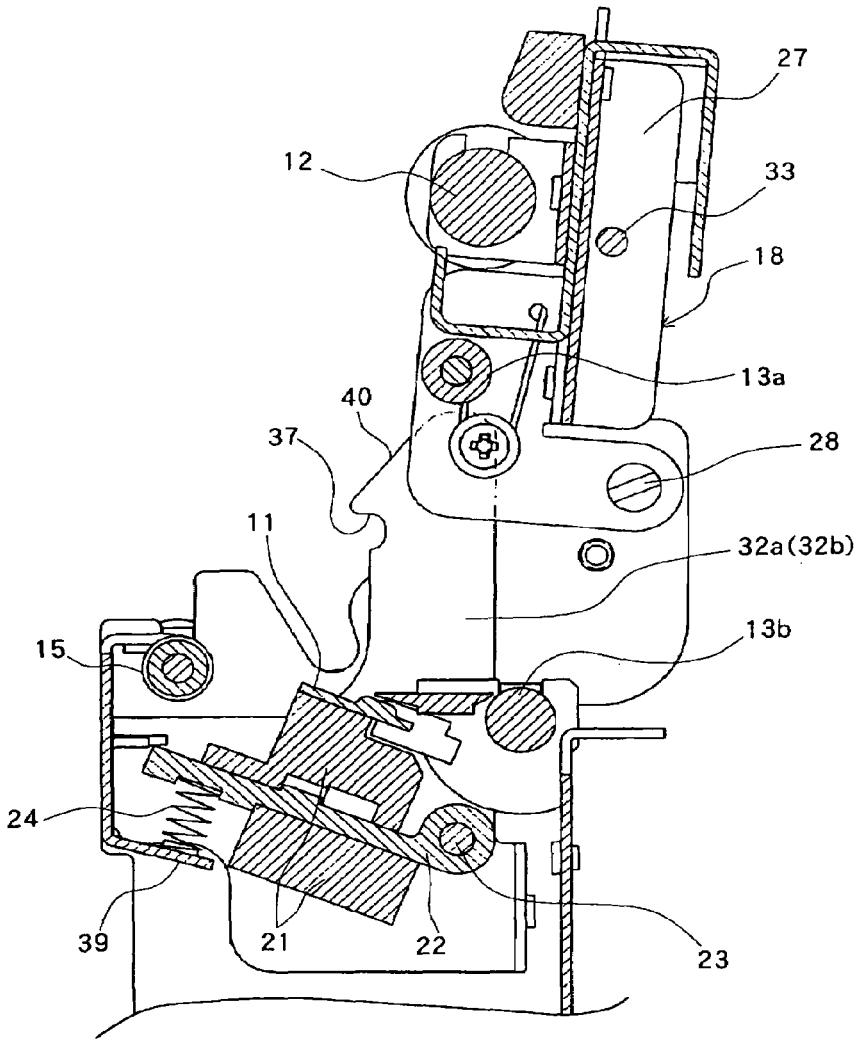
FIG. 8 is a cross-sectional view showing a state where an engaged state of lock arms and lock pins is released in the platen lock mechanism.

Moreover, as shown in FIG. 8, the thermal activation head 11 is provided on a radiator 21, and the radiator 21 is supported by a rotary support member 22. In the rotary support member 22, one end thereof is supported by a rotation support shaft 23 so as to be rotatable, and the other end is urged with an elastic force of a compression coil spring 24. Hence, the rotary support member 22 is rotated about the rotation support shaft 23 in directions of arrows $a_1$ and $a_2$ by the urging force from the compression coil spring 24, and the thermal activation head 11 is brought into press contact with the peripheral surface of the platen roller 12.

The platen roller 12 is supported by a rotary shaft 25, and both ends of the rotary shaft 25 are supported on a bearing 26 so as to be rotatable. As shown in FIG. 3, the platen roller 12 is rotationally driven by a drive mechanism 29 having a gear array. As one of the conveyor rollers 13*a* and 13*b* is rotationally driven, the other is rotationally driven following the rotation of the one conveyor roller.

The base frames 17 are arranged on both sides in the width direction of the sheet material 3, and on the base frames 17, the rotary support member 22 for the thermal activation head 11, the conveyor roller 13*b*, and the discharge roller 15 are supported so as to be rotatable.

The platen unit 18 includes sub-frames 27 arranged on both sides in the width direction of the sheet material 3, and the sub-frames 27 are supported on the base frames 17 through a rotary shaft 28 so as to be rotatable in directions of arrows $b_1$ and $b_2$. Hence, the platen unit 18 is movable so as to allow the peripheral surface of the platen roller 12 into and out of contact with the thermal activation head. 11 by rotating in the directions of the arrows $b_1$ and $b_2$.

Figure 5:
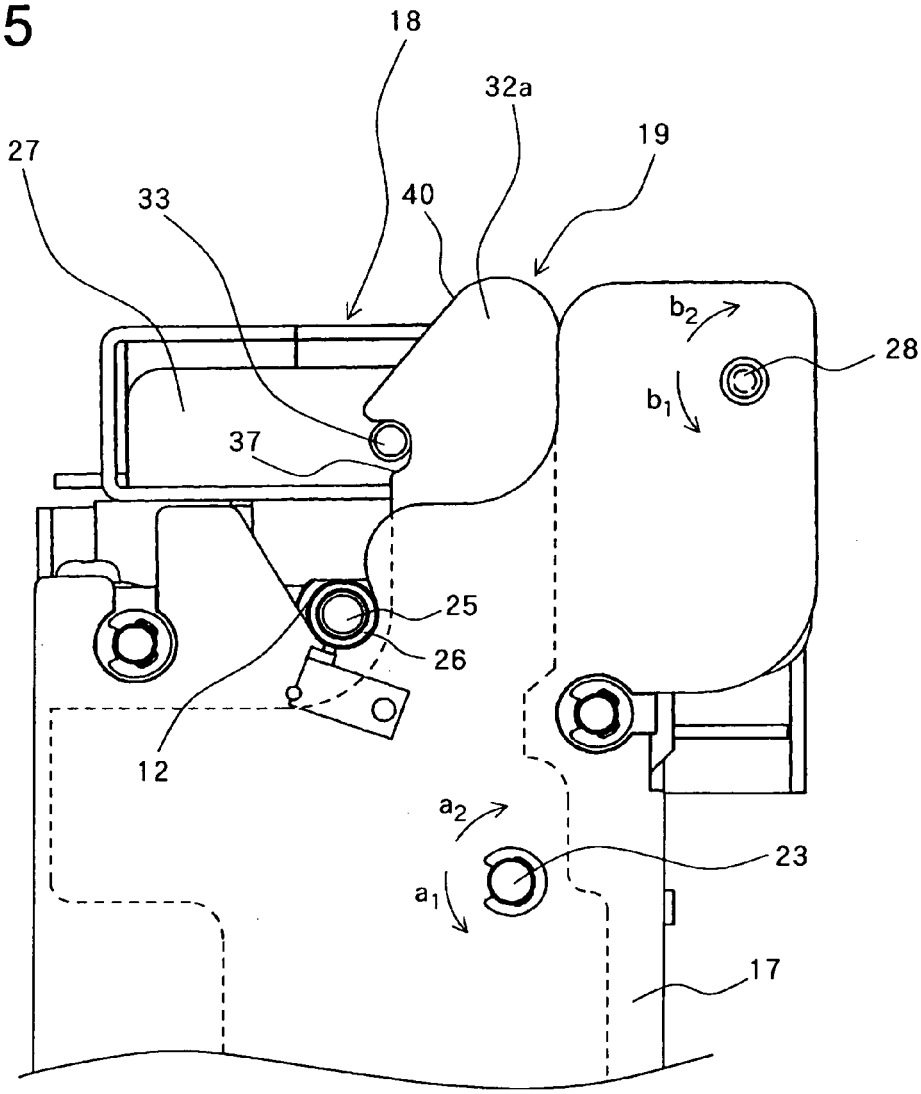
FIG. 5 is a side view showing a platen lock mechanism.
Figure 6:
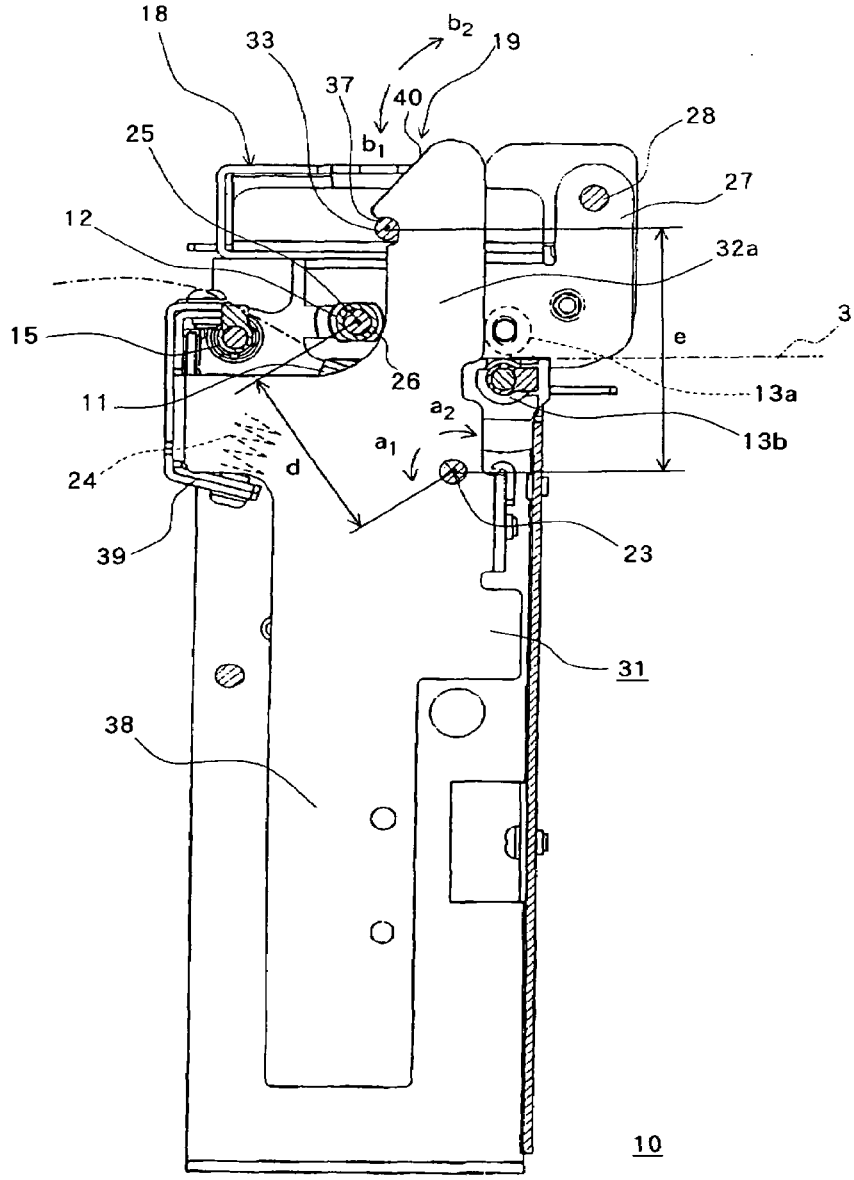
FIG. 6 is a side view for explaining the platen lock mechanism.

As shown in FIG. 5 and FIG. 6, the platen lock mechanism 19 includes a lock member 31 having a pair of lock arms 32*a* and 32*b* engaged with the platen unit 18, and lock pins 33 which are shaft members with which the lock arms 32 are engaged.

Figure 7:
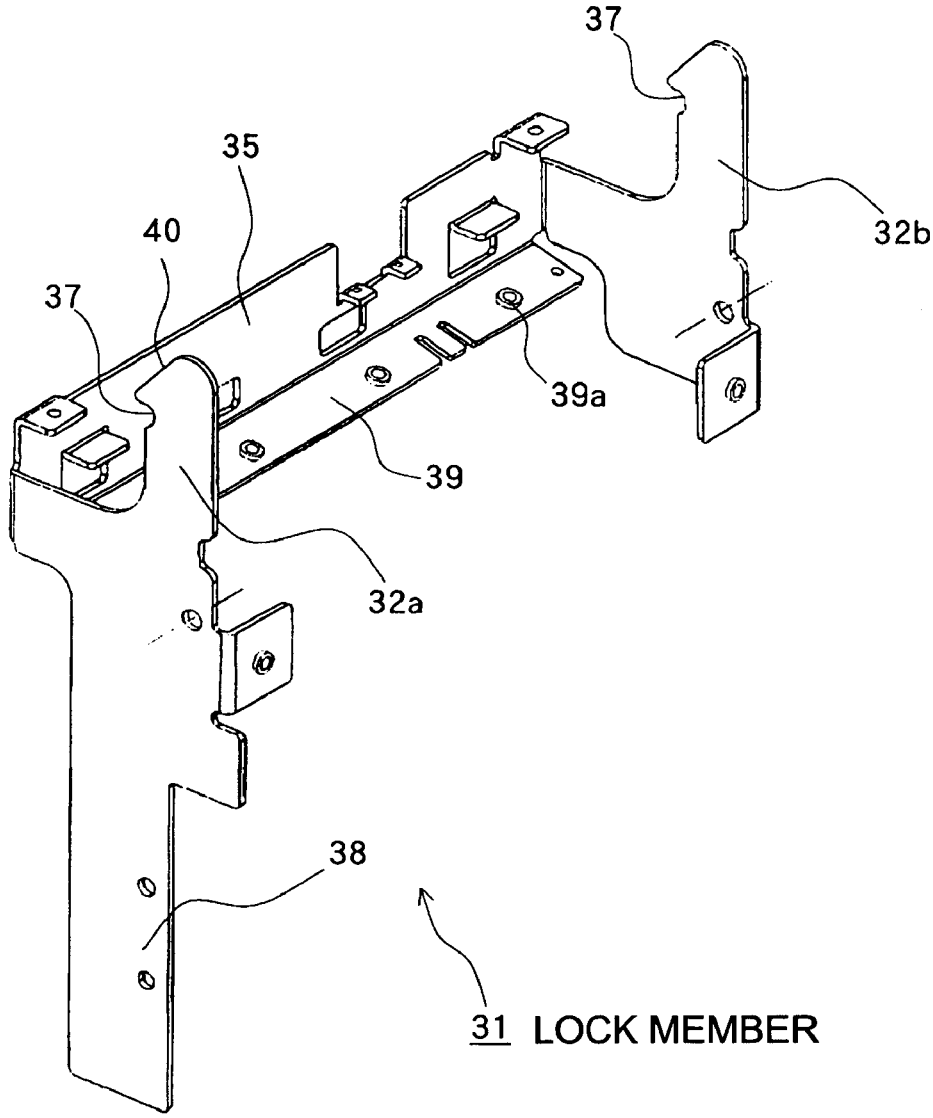
FIG. 7 is a perspective view showing a lock member.

As shown in FIG. 7, the lock member 31 is formed by integrally coupling the pair of lock arms 32*a* and 32*b*, which are individually engaged with the respective lock pins 33, through the intermediation of a coupling piece 35. As shown in FIG. 6, the lock member 31 is supported on the rotation support shaft 23 which functions as the rotation center of the rotary support member 22 supporting the thermal activation head 11 so as to be rotatable in the directions of the arrows $a_1$ and $a_2$.

The respective lock arms 32*a* and 32*b* are notched to form engagement grooves 37 that are engagement recesses with which the respective lock pins 33 are engaged. The engagement grooves 37 are formed into a substantially circular arc shape corresponding to the outer diameter of the lockpins 33. Moreover, in outer peripheral portions of the lock arms 32*a* and 32*b* which are continuous to the engagement grooves 37, operation portion 40 for rotating the lock member 31 in the direction of the arrow $a_2$ through a pressing operation by means of the lock pins 33 are formed into a substantially linear shape. Moreover, in the lock arm 32*a* that is one of the lock arms, an operation lever 38 is provided integrally therewith.

Moreover, the coupling piece 35 is integrally provided with a spring support piece 39 that is urged with the elastic force of the above-described compression coil spring 24 bringing the thermal activation head 11 into press contact with the platen roller 12. In the spring support piece 39, a protruding portion 39*a* engaged with a center hole of the compression coil spring 24 is provided.

Hence, the lock arms 32*a* and 32*b* of the lock member 31 are urged by the elastic force of the compression coil spring 24 so as to rotate about the rotation support shaft 23 in the direction of the arrow $a_1$ in a way similar to the thermal activation head 11, and the engagement grooves 37 of the respective lock arms 32*a* and 32*b* are engaged with the lock pins 33.

The lock pins 33 are fixed to the respective sub-frames 27 of the platen unit 18 so as to be in parallel to the rotary shaft 25 of the platen roller 12. The outer diameter of the lock pins 33 is set to be smaller than the outer diameter of the bearing 26 of the platen roller 12 and the outer diameter of the rotary shaft 25 thereof.

Moreover, as shown in FIG. 6, in a state where the platen roller 12 is in press contact with the thermal activation head 11, the axis of the lock pins 33 is at a position farther from the rotation support shaft 23, which is the rotation center of the lock arms 32*a* and 32*b*, than the rotary shaft 25 of the platen roller 12. In other words, a distance e between the axis of the rotation support shaft 23 which functions as the rotation center of the lock arms 32*a* and 32*b* and the axis of the lock pins 33 is set larger than a distance d between the axis of the rotation support shaft 23 of the lock arms 32*a* and 32*b* and the axis of the rotary shaft 25 of the platen roller 12.

The lock arms 32*a* and 32*b* are engaged with the lock pins 33 provided at the positions as described above. In this way, an operation range of the lock arms 32*a* and 32*b* about the rotary shaft 23, that is, the movement of the engagement grooves 37 when the lock arms 32*a* and 32*b* shift between a locking state and an unlocking state can be made smaller than in the case where the lock arms 32*a* and 32*b* are engaged with the outer peripheral portions of the rotary shaft 25 and bearing 26 of the platen roller 26.

The reduced operation range of the lock arms 32*a* and 32*b* makes it possible to arrange the conveyor rollers 13*a* and 13*b* in close proximity to the platen roller 12 without making the conveyor rollers 13*a* and 13*b* interfere with the rotating lock arms 32*a* and 32*b*.

Moreover, as the operation range of the lock arms 32*a* and 32*b* becomes smaller, it is possible to reduce compression of the compression coil spring 24 which urges the lock arms 32*a* and 32*b*. Accordingly, a relatively small compression coil spring can be used.

Note that the above-mentioned platen lock mechanism 19 is constructed such that the lock pins 33 are provided on the platen unit 18 side, and that the engagement grooves 37 with which the lock pins 33 are engaged are formed on the lock arms 32*a* and 32*b* side. However, any construction may be employed as long as the lock pins 33 are located farther than the rotation center of the platen roller 12 with respect to the rotation center of the lock arms 32*a* and 32*b*. For example, a construction may also be adopted in which the lock pins 33 are provided on the lock arms 32*a* and 32*b* side, and the engagement grooves are formed on the sub-frames 27 on the platen unit 18 side.

With regard to the platen lock mechanism 19 provided in the thermal activation device 10 constructed as described above, an operation of engaging the lock arms 32*a* and 32*b* of the lock member 31 with the lock pins 33 will be described with reference to the drawings.

First, as shown in FIG. 8, in the platen lock mechanism 19, the engaged state of the engagement grooves 37 of the lock arms 32*a* and 32*b* with the lock pins 33 is released, and thus the platen unit 18 is rotated in the direction of the arrow $b_2$ with respect to the base frames 17 so as to open. In the thermal activation device 10, work such as exchange and maintenance of the thermal activation head 11 is performed in this state, and good workability is thus maintained.

Figure 9:
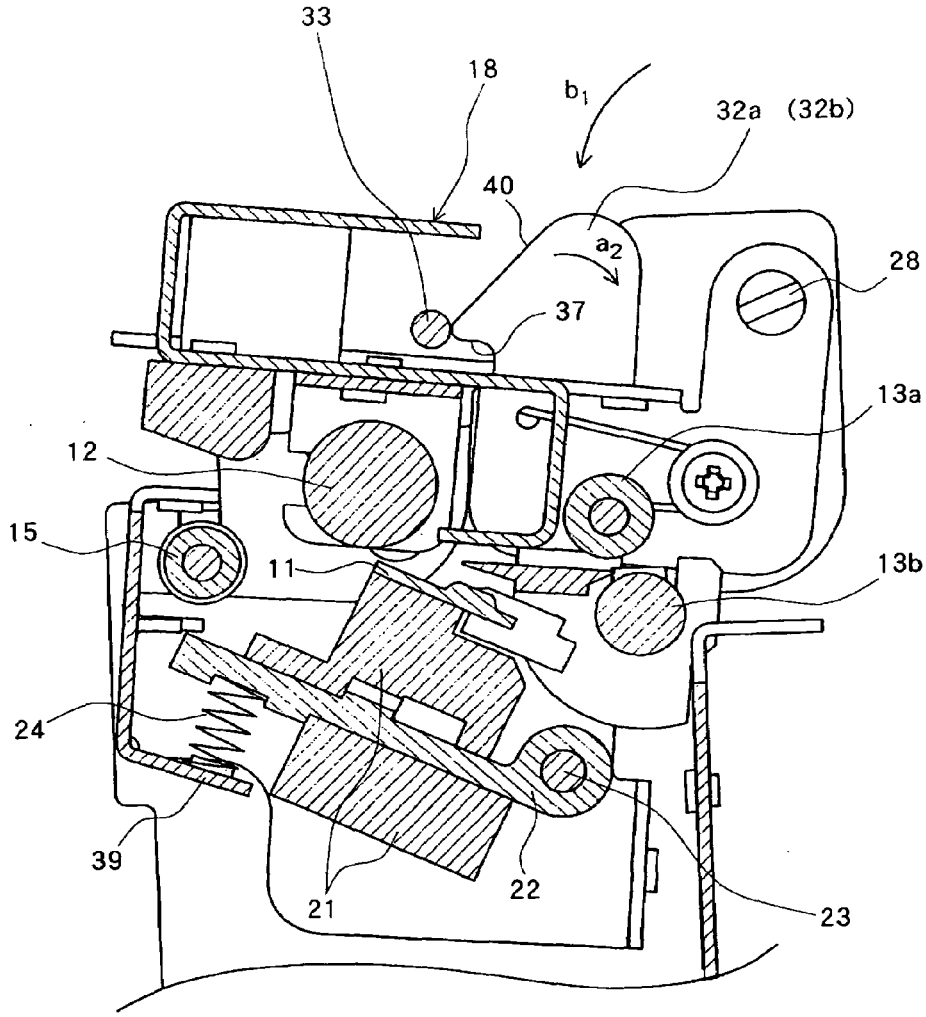
FIG. 9 is a cross-sectional view showing a state where the lock arms are halfway engaged with the lock pins in the platen lock mechanism.

Subsequently, as shown in FIG. 9, the platen unit 18 is rotated in the direction of the arrow $b_1$ with respect to the base frames 17, and the lock pins 33 are thus made to abut on the operation portions 40 of the lock arms 32*a* and 32*b*. As the platen unit 18 is further rotated in the direction of the arrow $b_1$, the lock pins 33 are moved along the operation portions 40, and the lock arms 32*a* and 32*b* are rotated in the direction of the arrow $a_2$ by the lock pins 33 against the urging force of the compression coil spring 24.

Figure 10:
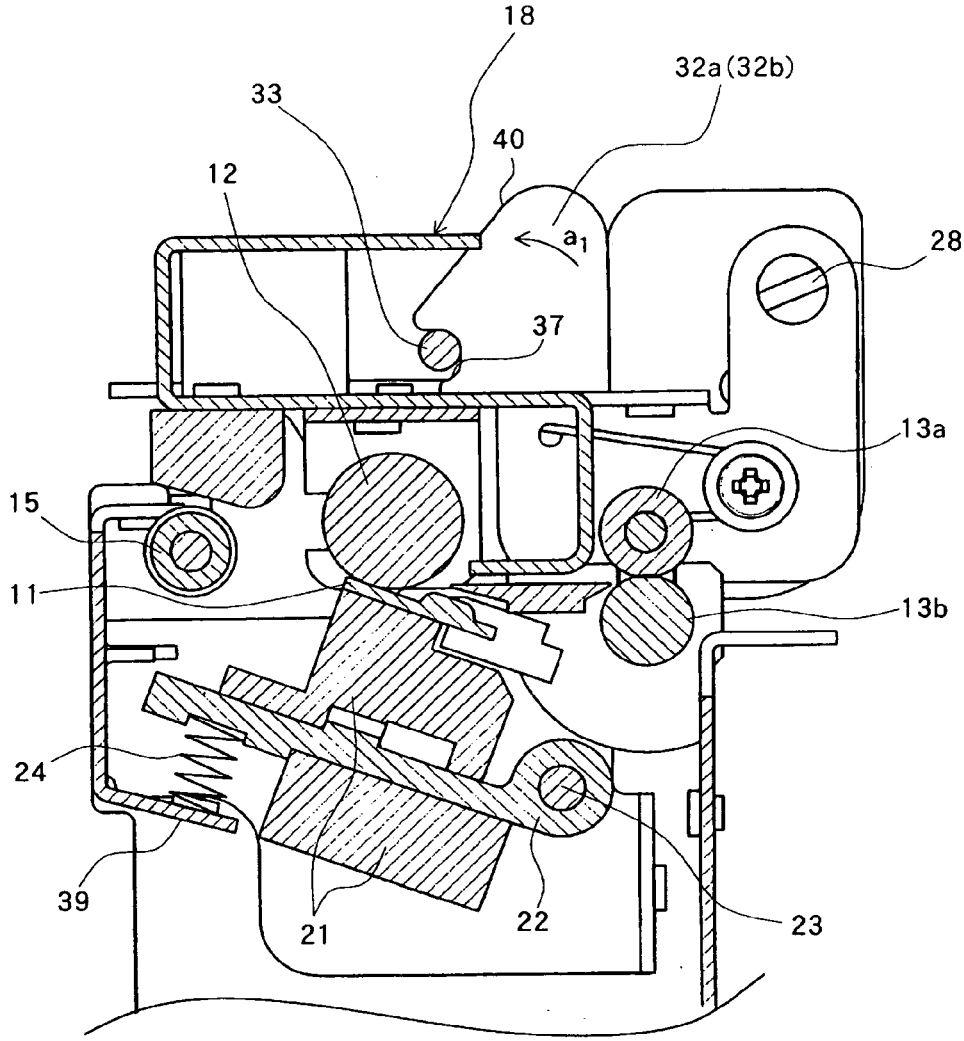
FIG. 10 is a cross-sectional view showing a state where the lock arms are engaged with the lock pins in the platen lock mechanism.
Figure 11:
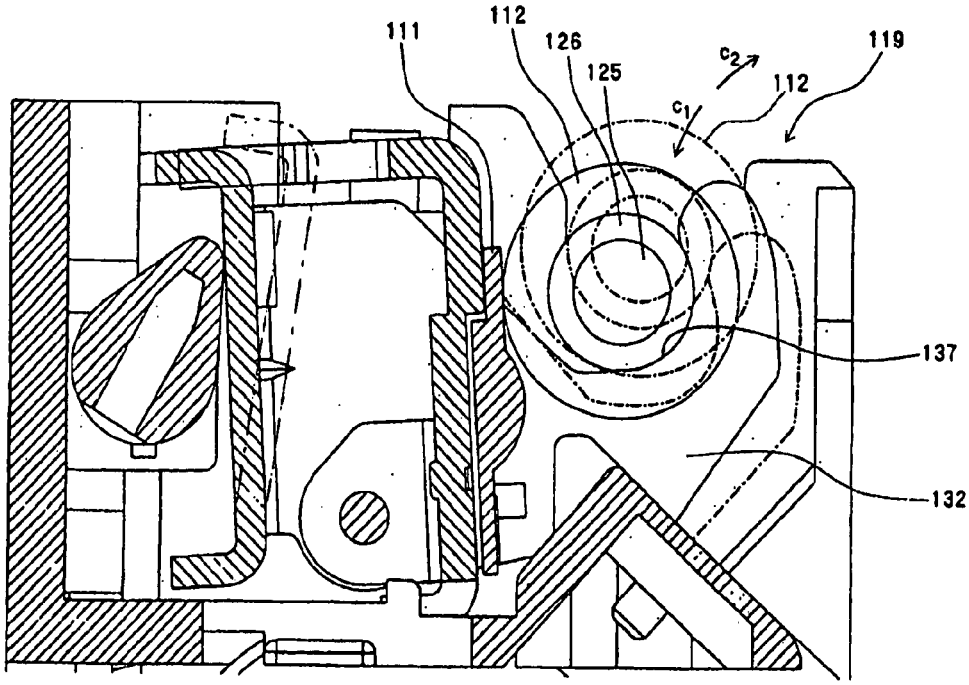
FIG. 11 is a cross-sectional view for explaining a platen lock mechanism provided in a conventional thermal activation device.

Then, as shown in FIG. 10, when the lock pins 33 has moved past the operation portions 40 to a position corresponding to the engagement grooves 37, the lock arms 32*a* and 32*b* are rotated in the direction of the arrow $a_1$ by the urging force of the compression coil spring 24, and the lock pins 33 are engaged with the engagement grooves 37. The lock pins 33 are thus engaged with the engagement grooves 37 of the lock arms 32*a* and 32*b*, whereby the platen unit 18 is locked in a state where the thermal activation head 11 is in press contact with the peripheral surface of the platen roller 18.

Moreover, in the platen lock mechanism 19, in the case of releasing the locking of the platen unit 18, the operation lever 38 provided in the lock arm 32 that is one of the lock arms is operated so as to rotate in the direction of the arrow $a_2$ against the urging force by the compression coil spring 24, and the engaged state of the engagement grooves 37 of the respective lock arms 32*a* and 32*b* with the respective lock pins 33 is thus released, thus making it possible to operate the platen unit 18 so as to rotate in the direction of the arrow $b_2$ with respect to the sub-frames 27.

As described above, in the thermal activation device 10, the platen lock mechanism 19 includes the lock pins 33 provided at the position farther than the rotary shaft 25 constituting the rotation center of the platen roller 12 with respect to the rotation support shaft 23 constituting the rotation center of the lock arms 32*a* and 32*b*. Thus, the operation range of the lock arms 32*a* and 32*b* in the case where the lock arms 32*a* and 32*b* shift between the locking state and the unlocking state is reduced. Therefore, according to the thermal activation device 10, it is possible to arrange the conveyor rollers 13*a* and 13*b* and the discharge roller 15 at positions close to the platen roller 12, and the overall miniaturization of the thermal activation device 10 can be achieved.

Moreover, according to the thermal activation device 10, because it is possible to arrange the conveyor rollers 13*a* and 13*b* at positions close to the platen roller 12, it is possible to convey the sheet material 3 such as a cut sheet having a relatively short length in the conveying direction. Furthermore, according to the thermal activation device 10, an amount of deflection, which occurs in the sheet material 3 between an upstream-side holding position by the conveyor rollers 13*a* and 13*b* and a downstream-side holding position by the platen roller 12 and the thermal activation head 11, is suppressed. Conveying force by the conveyor rollers 13*a* and 13*b* is smoothly transmitted to the sheet material 3 owing to the elastic force of the sheet material 3 itself, allowing the sheet material 3 to be smoothly forwarded by the conveyor rollers 13*a* and 13*b*, and conveying force by the platen roller 12 is supplemented. As a result, it is possible to restrict the sheet material 3 from inclining with respect to the conveying direction to cause skew feed.

Note that, though the thermal activation device employing the platen lock mechanism according to the present invention has been described in this embodiment, as a matter of course, the platen lock mechanism may also be applied to a printing apparatus provided in a label issuing apparatus. Moreover, though the sheet material having the thermal printing layer has been adopted in the thermal activation device of the above-described embodiment, for example, other sheet materials having a pressure-sensitive printing layer and the like may also be used.

What is claimed is:

1. A thermal activation device, comprising:

heating means for thermally activating a heat-sensitive adhesive layer of a sheet material having the heat-sensitive adhesive layer;

a platen unit having a platen roller mounted to undergo rotation about a rotational axis for conveying the sheet material, the platen unit being movable in a direction for bringing the platen roller into and out of press contact with the heating means; and a platen lock mechanism for locking the platen roller and the heating means into press contact with each other, the platen lock mechanism having a lock arm engaged with the platen unit and mounted to undergo rotation about a rotational axis, a shaft member provided in one of the platen unit and the lock arm, an engagement recess for engagingly receiving the shaft member and provided in the other of the platen unit and the lock arm, and an urging member for urging the lock arm in a direction for bringing the shaft member into engagement with the engagement recess;

wherein in a state in which the heating means is in press contact with the platen roller, a distance between the rotational axis of the lock arm and an axis of the shaft member is greater than a distance between the rotational axis of the lock arm and the rotational axis of the platen roller.

2. A thermal activation device according to claim 1; wherein an outer diameter of the shaft member is smaller than an outer diameter of a rotary shaft of the platen roller or an outer diameter of a bearing which supports the rotary shaft.

3. A thermal activation device according to claim 1; wherein the shaft member is provided in the platen unit.

4. A thermal activation device according to claim 1; wherein the heating means includes a thermal head.

5. A thermal activation device according to claim 1; further comprising a pair of conveyor rollers for conveying the sheet material toward the heating means.

6. A printer, comprising:

printing means for printing on a sheet material;

a platen unit having a platen roller mounted to undergo rotation about a rotational axis for conveying the sheet material, the platen unit being movable in a direction for bringing the platen roller into and out of press contact with the printing means; and a platen lock mechanism for locking the platen roller and the printing means into press contact with each other, the platen lock mechanism having a lock arm engaged with the platen unit and mounted to undergo rotation about a rotational axis, a shaft member provided in one of the platen unit and the lock arm, an engagement recess for engagingly receiving the shaft member and provided in the other of the platen unit and the lock arm, and an urging member for urging the lock arm in a direction for bringing the shaft member into engagement with the engagement recess;

wherein in a state in which the printing means is in press contact with the platen roller, a distance between the rotational axis of the lock arm and an axis of the shaft member is greater than a distance between the rotational axis of the lock arm and the rotational axis of the platen roller.

7. A printer according to claim 6; wherein an outer diameter of the shaft member is smaller than one of an outer diameter of a rotary shaft of the platen roller and an outer diameter of a bearing that supports the rotary shaft.

8. A printer according to claim 6; wherein the printing means includes a thermal head for performing printing by thermally activating a thermal printing layer of the sheet material.

9. A printer according to claim 6; further comprising a pair of conveyor rollers for conveying the sheet material toward the printing means.

10. A thermal activation device according to claim 1; wherein the urging member comprises a coil spring.

11. A printer according to claim 6; wherein the urging member comprises a coil spring.

* * * * *